US008757282B2

(12) United States Patent
Rousseau et al.

(10) Patent No.: US 8,757,282 B2
(45) **Date of Patent: *Jun. 24, 2014**

(54) SELF SERVICING FIRE EXTINGUISHER WITH INTERNAL MIXING AND EXTERNAL $CO_2$ CHAMBER

(76) Inventors: Hector Rousseau, Riverside, CA (US); Randy Rousseau, Riverside, CA (US)

( * ) Notice: Subject to any disclaimer, the term of this patent is extended or adjusted under 35 U.S.C. 154(b) by 522 days.

This patent is subject to a terminal disclaimer.

(21) Appl. No.: 12/851,169

(22) Filed: Aug. 5, 2010

(65) Prior Publication Data

US 2010/0294522 A1 Nov. 25, 2010

Related U.S. Application Data

(63) Continuation-in-part of application No. 11/578,494, filed as application No. PCT/US2006/041157 on Oct. 12, 2006, now Pat. No. 7,793,737.

(51) Int. Cl.
*A62C 8/00* (2006.01)
*A62C 35/58* (2006.01)
*A62C 11/00* (2006.01)

(52) U.S. Cl.
USPC ..... 169/71; 169/81; 169/83; 169/80; 169/30

(58) Field of Classification Search
USPC ..... 169/71, 81, 83, 88, 30
See application file for complete search history.

(56) References Cited

U.S. PATENT DOCUMENTS 674,827 A 5/1901 Edmands
907,029 A 12/1908 Giseke
1,272,012 A * 7/1918 Connor ..... 169/85
1,354,093 A 9/1920 Davidson
1,733,724 A 10/1929 Downs
1,790,231 A 1/1931 Dugas
2,017,319 A 10/1935 McMullen
2,067,829 A 1/1937 Dennel
2,430,470 A 11/1947 Keefe, Jr.
2,489,339 A 11/1949 Stroop
2,541,554 A 2/1951 Smith
2,569,975 A 10/1951 Cone
2,592,029 A 4/1952 Hansen
2,785,759 A 3/1957 Fleming et al.
3,149,677 A 9/1964 Blair
3,255,824 A 6/1966 Rodgers
3,618,669 A 11/1971 Sachs (Continued)

FOREIGN PATENT DOCUMENTS

GB 447936 5/1936

*Primary Examiner* — Justin Jonaitis
(74) *Attorney, Agent, or Firm* — Kirk A. Buhler; Buhler & Associates

(57) ABSTRACT

Improvements to a portable fire extinguisher are disclosed. The improvements allow for frequent and simpler untrained and automatic self-servicing of a fire extinguisher. The improvements include an anti-bridging mechanism that can be articulated from the exterior of the chamber to fluff, mix or stir the powder within the chamber to keep it in a liquefied state. Additional improvements include a larger opening to more quickly fill and inspect the powder within the chamber. Another improvement includes the use of a $CO_2$ canister located external to the chamber to allow easier servicing or replacement of just the $CO_2$ canister as well as the ability to maintain the chamber in an un-pressurized condition, allows for non-HASMAT shipping. These features will extend the service intervals while maintaining the fire extinguisher in a ready condition.

7 Claims, 4 Drawing Sheets

(56) References Cited

U.S. PATENT DOCUMENTS

| | | | | |
|---|---|---|---|---|
| 3,713,493 | A | 1/1973 | Hansen | |
| 3,719,232 | A | 3/1973 | Gubela | |
| 3,858,659 | A | 1/1975 | Fukushima | |
| 4,372,394 | A | 2/1983 | Allegri, Sr. | |
| 4,505,336 | A | 3/1985 | Thevis et al. | |
| 4,567,948 | A | 2/1986 | Rozniecki | |
| 4,650,004 | A | 3/1987 | Wendling et al. | |
| 4,862,968 | A | 9/1989 | Woodman | |
| 6,189,624 | B1 | 2/2001 | James | |
| 6,378,740 | B1 | 4/2002 | Martin | |
| 6,527,058 | B1 | 3/2003 | Nerat | |
| 7,128,163 | B1 * | 10/2006 | Rousseau et al. | 169/77 |
| 2004/0166266 | A1 | 8/2004 | De Wit | |
| 2005/0060953 | A1 | 3/2005 | Altonen et al. | |

* cited by examiner

SELF SERVICING FIRE EXTINGUISHER WITH INTERNAL MIXING AND EXTERNAL $CO_2$ CHAMBER

CROSS REFERENCE TO RELATED APPLICATION

This application is a continuation-in-part of applicant's application Ser. No. 11/578,494 filed Oct. 12, 2006, now U.S. Pat. No. 7,793,737 that issued on Sep. 14, 2010, International application PCT Ser. No. PCT/US06/41157 also filed Oct. 12, 2006, which claims priority to application Ser. No. 11/515,471 filed Sep. 1, 2006, now U.S. Pat. No. 7,318,484 that issued on Jan. 15, 2008, and is a continuation-in-part of application Ser. No. 11/266,815 filed Oct. 4, 2005, now U.S. Pat. No. 7,128,163 that issued on Nov. 31, 2006, and application Ser. No. 11/714,611 that was filed Mar. 6, 2007 now U.S. Pat. No. 7,650,948 that issued on Jan. 26, 2010 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention relates to improvements in portable fire extinguishers. More particularly, the present invention relates to a fire extinguisher that allows for external mixing, fluffing, actuating or stirring of the powder within the chamber to provide anti-bridging of the powder to keep it in a liquefied state, a larger opening in the chamber to allow easier filling of the chamber and a $CO_2$ canister that is located external to the extinguisher chamber.

2. Description of Related Art including information disclosed under 37 CFR 1.97 and 1.98

Most portable fire extinguishers are of a similar design where the fire extinguishing powder is contained in a pressurized chamber. Fire extinguishers of this type require scheduled maintenance because the powder within the chamber can settle and cake preventing it from being dispensed when needed. The pressure within the chamber may also leak over time and be insufficient to propel the powder out of the dispensing nozzle. A further limitation, based upon this design is due to the pressurized condition of the chamber, powder is placed into the chamber in a small opening in the top of the extinguisher. This scheduled maintenance allow moisture intrusion causing caking. Current extinguishers can only be service by trained certified technicians, and the certification is issued by the fire marshal for each state.

Current extinguishers are open to wear and tear because of the constant pressure and tear down process. When serviced they are fires into a recycling chamber and all the parts must be disassembled and cleaned. All the pressure rings must be replaced and every part must them be re-assembled with new powder being placed within the chamber prior to pressurizing the chamber. The servicing of current fire extinguishers often creates more wear and tear on the fire extinguisher than when it is used to extinguish a fire.

U.S. Pat. No. 6,189,624 issued to James on Feb. 20, 2001 and Japan Patent Number JP 9,225,056 issued to Yamazaki Tomoki on Sep. 2, 1997 discloses fire extinguishing mechanisms where the chamber is not continuously pressurized, and the pressurized chamber is a separate entity integrated within the chamber. While these patents disclose a separate pressurized canister, the canister is not located in a position that is easy to service, replace, or inspect. This minimizes the ability determine the charge level of the $CO_2$ cartridge.

U.S. Pat. No. 2,541,554 issued to C H Smith on Feb. 13, 1951 and Russian Patent Number RU 2,209,101 issued to Glavatski G. D. Et Al. Nov. 2, 2002 discloses a fire extinguisher with external $CO_2$ gas cartridge. In the case US '554 the $CO_2$ gas cartridge sits on top of the fire extinguisher chamber and is not integrated within the handle of the fire extinguisher. In the case of RU '101 the $CO_2$ gas cartridge is external to the extinguisher and is connected to the extinguisher with a pipe or hose. While both of these patents disclose a $CO_2$ cartridge that is external to the chamber, neither of them is placed in the handle to allow a configuration of the fire extinguisher that is simple to inspect and replace.

Due to the pressurized condition that exists with pressurized fire extinguishers, the opening where powder is placed into the extinguisher is limited due to the structural requirement to maintain pressure within the chamber at all times. The proposed application eliminates this need by providing an external $CO_2$ gas cartridge, thus allowing the chamber to exist in a normally un-pressurized condition. Because the chamber is not under pressure the top opening of the extinguisher can be enlarged to allow easier filling of the fire extinguisher with powder, or checking the amount and or condition of the powder within the chamber.

What is needed is a fire extinguisher with an external gas cartridge where the gas cartridge is located in the handle, a fluffer is accessible from outside the chamber, and the chamber has an enlarged top opening for filling the extinguisher. The proposed fire extinguisher provides this solution by providing a fire extinguisher with an external gas cartridge, external fluffer and large opening.

BRIEF SUMMARY OF THE INVENTION

It is an object of the fire extinguisher to eliminate the need for service personnel to enter secure areas. The extinguisher can have a higher level of service. Can be operated automatically "self-service" and or manually services by the owner or end user. This eliminates the need for non-employees to enter the privacy of business and government areas. This extinguisher can be operated, maintained, refilled and charged with no special training or equipment allowing for anyone who purchases it to have it function like any of the office equipment that is available to day like a copier, printer or water cooler. The proposed fire extinguisher is not required to be broken down when it has been fired.

The reduced outside servicing and maintenance of the fire extinguisher is ideal for placement of the fire extinguisher to be placement in secure areas. This will reduce or eliminate the possibility that a terrorist could utilize the fire extinguisher as a weapon, or use false identity as an extinguisher service person to gain access to a secure area.

It is an object of the fire extinguisher to provide a fire extinguisher with an external gas canister. The external canister allows the chamber to exist at or near ambient pressure that reduces the need to utilize a high strength chamber. The standard $CO_2$ cartridge that is used in other applications can be easily adapted to operate with the fire extinguisher. Since the $CO_2$ cartridge is external to the chamber it can be easily replaced or swapped without replacing the entire fire extinguisher. This provides a tremendous benefit when a large number of fire extinguishers need to be service at one time.

It is another object of the fire extinguisher to provide a fire extinguisher with an externally accessible fluffing mechanism. The externally accessible fluffing mechanism promotes anti-bridging of the powder within the chamber to keep it fluffed, agitated, stirred or disturbed to prevent caking of the powder and keep the powder in a liquefied state so it is easier to spray the powder onto a fire. The fluffing is accomplished with paddles, flapper, chains rods or other mixing mechanisms located within the chamber. The mixing mechanism is accessed by a connection on the top, bottom or side of the chamber and can be either manually operated or operated with a key of some type.

It is still another object of the fire extinguisher to provide a fire extinguisher with an enlarged filling opening. The enlarged filling opening makes it easier and faster to fill and or empty the chamber. The top can also be easily removed to visually inspect the condition of the powder within the chamber.

It is still another object of the fire extinguisher to provide have a quick opening and closing top housing thereby allowing a user to quickly open and refill the fire extinguisher. This also allows a fire fighter the load the desired fire extinguishing media based upon the type of fire.

Various objects, features, aspects, and advantages of the present invention will become more apparent from the following detailed description of preferred embodiments of the invention, along with the accompanying drawings in which like numerals represent like components.

DETAILED DESCRIPTION

Figure 1:
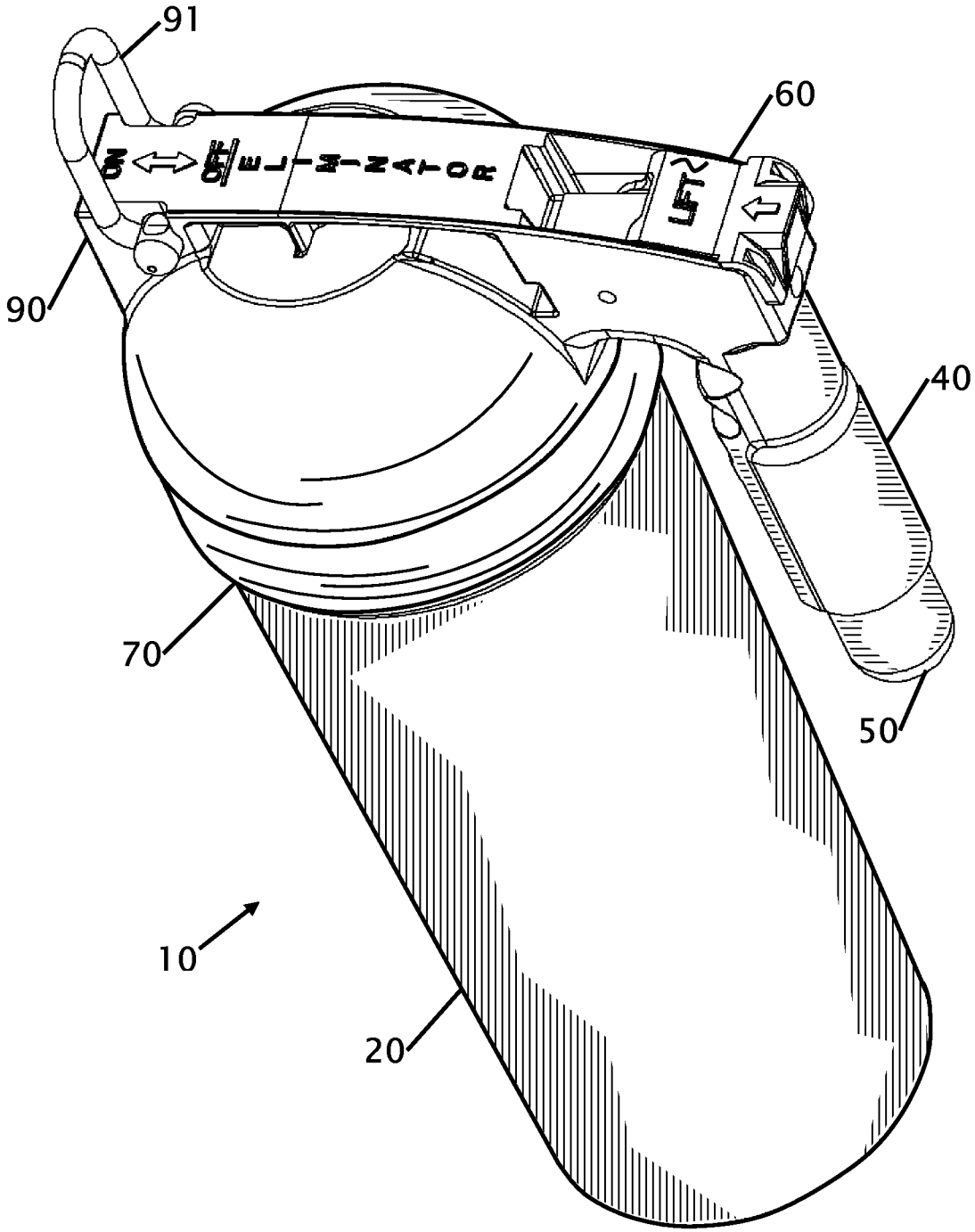
FIG. 1 shows an isometric view of a preferred embodiment of the improved fire extinguisher.

FIG. 1 shows an isometric view of a preferred embodiment of the improved fire extinguisher 10. The chamber 20 is substantially a cylindrical shape with a bottom and a top. In the preferred embodiment the chamber is made from a lightweight resilient material such as plastic, but the chamber could also be made of steel, brass, copper or aluminum. On the top of the chamber the fire extinguishing dispensing apparatus is provided. The top is screwed onto the chamber, but it could also be attached with a bayonet or latching mechanism. The lid fits on top of an enlarged opening 70 on the chamber to allow easier filling of the chamber 20 with fire retardant materials. A wall hanging mechanism can be incorporated into the top of the extinguisher, wrap around the body of the cylinder or fork the top of the extinguisher. A handle 40 allows the operator to hold the extinguisher in an upright orientation when it is being used. The fire extinguisher can also be stored and or transported in the upright orientation, but the upright orientation is not critical for the storage or operation of the extinguisher. Within the handle 40 a pressurized gas canister 50 is located. While in the preferred embodiment the pressurized gas canister is shown within the handle other locations such as within the top of the extinguisher or adjacent to the hose are contemplated.

The canister 50 consists essentially of a compressed gas cartridge, but canisters of different types of gas are possible that do not promote spreading of the fire. Because the gas within the canister is under high pressure or in a liquid state, a small canister of gas is required to expel the contents of the chamber 20. It is also contemplated that multiple gas canisters can be placed within the handle to accommodate a larger fire extinguisher without deviating from the inventive nature of the design. Gas canisters are available from a variety of sources and can be replaced or serviced without the need to service the entire fire extinguisher. The handle 40 provides some protection to the canister in the event the fire extinguisher is dropped or roughly handled. A trigger mechanism 60 opens the gas canister to pressurize the chamber and expel the fire extinguishing media into and out of the exit port or application nozzle 90. A control valve 91 opens and closes the exit port to prevent fire extinguishing powder from pouring out of the extinguisher when the trigger 60 is no longer being depressed. The path from the gas canister 50 to the application nozzle 90 is best shown and described in FIG. 2.

Figure 2:
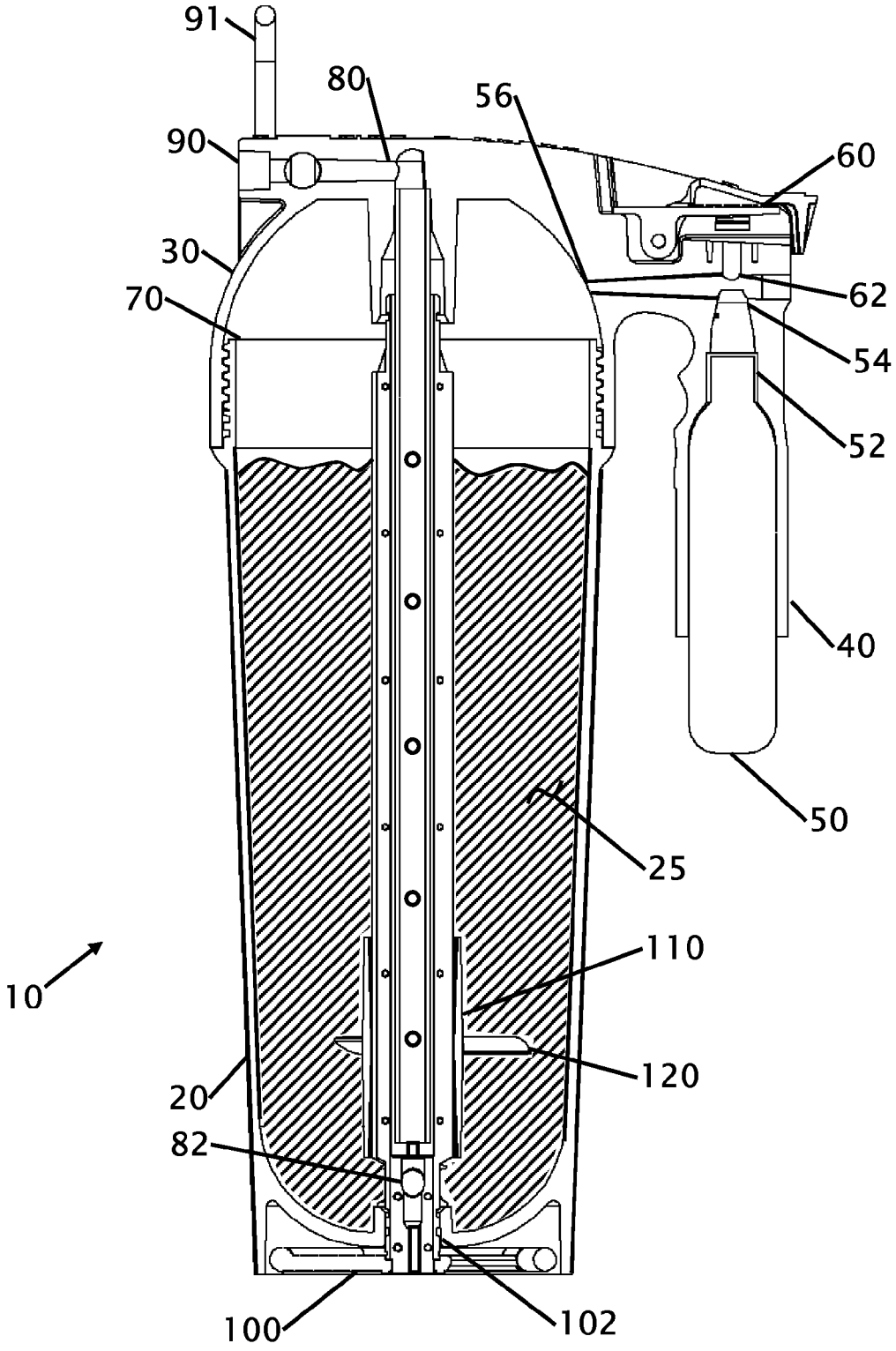
FIG. 2 shows a side sectional view of the preferred embodiment of the fire extinguisher shown in FIG. 1.

FIG. 2 shows a side sectional view of the preferred embodiment of the fire extinguisher 10 shown in FIG. 1. This figure shows the chamber 20 filled with the fire extinguishing media 25. In the preferred embodiment the chamber is made from a lightweight resilient material such as plastic, but the chamber could also be made of steel, brass, copper or aluminum. Various types of fire extinguishing media can be placed within the chamber. The upper portion of the chamber includes an enlarged opening 70 where it joins with the top 30 of the extinguisher. The enlarged opening 70 is greater than 50% of the diameter of the cylindrical fire extinguisher, but could be up to and including the same diameter as the cylinder with a threading mechanism located on the exterior lip of the cylinder. It is also contemplated that the cylinder be fabricated from tubular stock where both the top and the bottom of the extinguisher are identical and the ends are attached to the tube when the fire extinguisher is assembled. In the preferred embodiment the opening is between 75% and 90% of the diameter of the fire extinguisher. The larger opening allows the contents of the fire extinguisher to be filled, emptied, inspected, and serviced more easily. The top is screwed onto the chamber, but it could also be attached with a bayonet or latching mechanism. The top 30 of the fire extinguisher provides the propellant and the connections to emit the fire extinguishing material 25.

A gas filled canister 50 is located within the handle 40 of the extinguisher. It can be seen from this figure that the gas canister exists substantially within the handle. The handle provides some protection to the canister for accidental damage. A small portion of the gas canister extends beyond the end of the handle to allow access to the gas canister so it can be installed, removed or serviced without the need to disassemble other parts of the fire extinguisher. The gas canister is threaded into a fitting 52 within the handle of the extinguisher. The fitting can be of a variety of types that allows engagement of the canister to the extinguisher allowing the gas to be exhausted from the canister into the body of the fire extinguisher. A trigger 60 or other activation mechanism controls a valve 62 to regulate the flow of the gas from the canister through tube 54 and into the fire extinguisher at 56. Various safety pins, locks, tabs or other devices can be incorporated to reduce or prevent the possibility of accidental activation of the trigger.

In the figure the chamber is shown only partially filled to provide a view of the fluffing mechanism(s) 120. The fluffing mechanism conditions the fire retardant media to provide anti-bridging of the media within the chamber to agitate, fluff, turn, disturb, stir, ruffle, and or alters the condition of the media to allow the media to maintain a powder consistency. This allows the fire retardant powder media to remain in a liquefied state so it is easier to spray the powder onto a fire. The conditioning of the media can be performed using a variety of methods and in the preferred embodiment the conditioning is performed with an appendage 110 that can be articulated from the exterior 100 of the chamber. A seal 102 prevents fire extinguishing media and or pressurized gas from blowing out of the eternal fluffing connection 100. The appendage is a shaft that extends the length of the chamber and has a number of flaps 120 attached to the appendage. While flaps are shown and used in the preferred embodiment a variety of other appendages are contemplated that can condition the media that include but are not limited to rods, paddles, arms, disks, cable, chains or combination thereof. It is also contemplated that the appendage can be a simple hook or chain that conditions the fire extinguishing media. As previously described the appendage terminates 100 at the bottom of the chamber where it can be articulated, but the appendage could terminate at the top or sides of the chamber. The termination at the bottom of the chamber can allow articulation that requires either a key to attach to the appendage, or may terminate with manual knob, handle, wheel or other extension.

A hole 82 extends from bottom of the fluffing tube within the chamber to a passage 80 that transports the fire extinguishing media from within the chamber to the application nozzle 90 where it exits through a hole in the end of the nozzle. In operation when the trigger 60 is depressed the valve 62 is opened and gas from the canister 50 is expelled from the tube 54 into the chamber 20. A powder expeller valve 91 is closed to prevent power from spilling out the end of the hose when not in use, and opened to allow the powder to dispense on a fire when needed. The chamber becomes pressurized and fire suppressant media 25 is pushed through tube 82 where it is dispensed out the port 80 and through the nozzle 90. In another contemplated embodiment the nozzle is flexible to allow a user to hold the fire extinguisher and direct the fire extinguishing media out of the hose to a fire. While an open port 90 is shown in the preferred embodiment other dispensing orifices can be used such as valves, tubing, spray nozzles or similar are contemplated. It is contemplated that an over pressure relief valve can be incorporated within the fire extinguisher to vent any excessive pressure from within the cylinder that could cause the fire extinguisher to burst due to over pressurization of the chamber. Another contemplated feature can be a pressure gauge that will provide information on the amount of pressure in the gas canister to ensure that it is sufficiently charged for use when needed. After using the fire extinguisher, it can be opened, refilled and the gas canister replaced to allow the fire extinguisher to be returned to service like other types of office equipment like copiers or printers.

Figure 3:
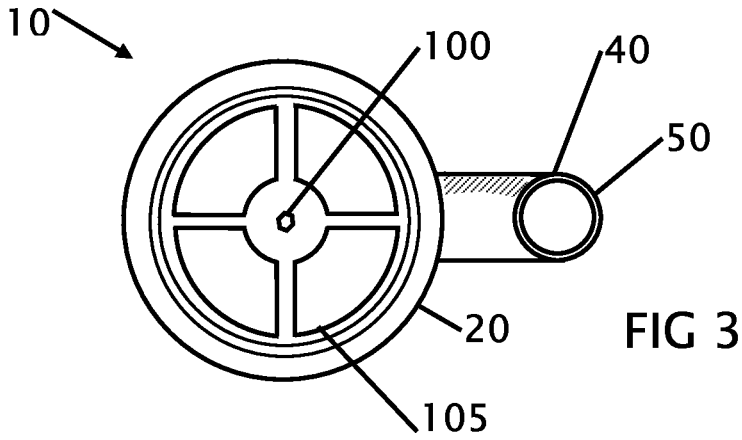
FIG. 3 shows a bottom view of the preferred embodiment of the fire extinguisher shown in FIG. 1.

FIG. 3 shows a bottom view of the preferred embodiment of the fire extinguisher 10 shown in FIG. 1. This view is one contemplated embodiment with access to the articulating appendage with a hex 100 or similar key drive attachment and a handle/knob 105 that can be manually turned to fluff the fire retardant media within the chamber 20. A battery powered drill or screwdriver can be attached to the hex drive socket and the powder within the fire extinguisher can be quickly fluffed. It is further contemplated that the fluffer could be operated by an automatic or manual motor that operates on a timer to fluff the powder at intervals. In this view the gas canister 50 is shown within the handle 40.

Figure 4:
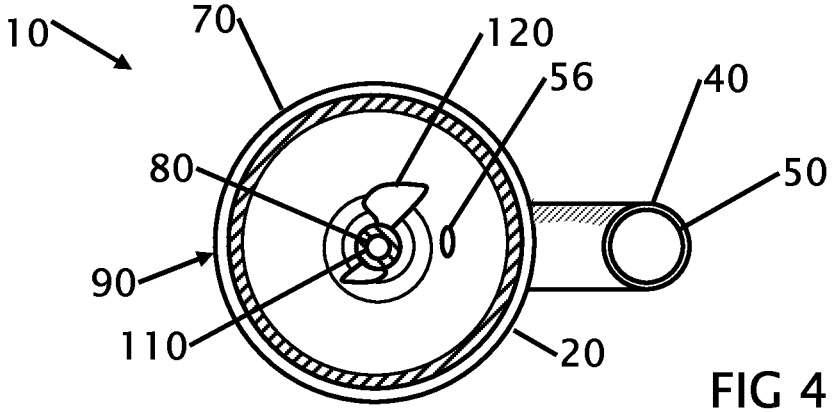
FIG. 4 shows a mid-cylinder sectional view of the preferred embodiment shown in FIG. 1.

FIG. 4 shows a mid-cylinder sectional view of the preferred embodiment shown in FIG. 1. This sectional view is cut through the chamber 20 to show the flapper(s) 120 on the appendage 110. The inlet tube 56 from the gas canister is shown in one contemplated location. The gas canister 50 is shown within the handle 40 with the activation trigger 60. The enlarged opening of the chamber 70 can be seen where it narrows from the body of the chamber 20. The exhaust passage 80 is shown that transports fire retardant media from the fire extinguisher passage and out the application nozzle 90.

Figure 5:
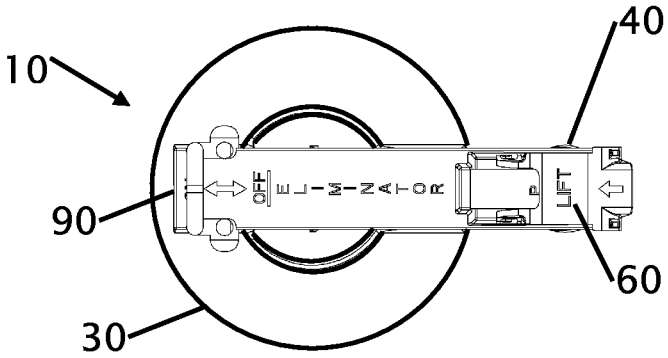
FIG. 5 shows a top view of the preferred embodiment of the fire extinguisher shown in FIG. 1.

FIG. 5 shows a top view of the preferred embodiment of the fire extinguisher 10 shown in FIG. 1. This view is one contemplated view as the fire extinguisher would appear when viewed from the top of the extinguisher. The gas canister is not visible but a portion of the handle 40 can be seen as it extends out the sides under the trigger mechanism cover 60. The handle 40 further provides some protection to the gas canister to reduce the possibility of damaging the gas canister. The chamber exists under the top 30 of the fire extinguisher and the nozzle 90 is shown on the side opposite the handle.

Figure 6:
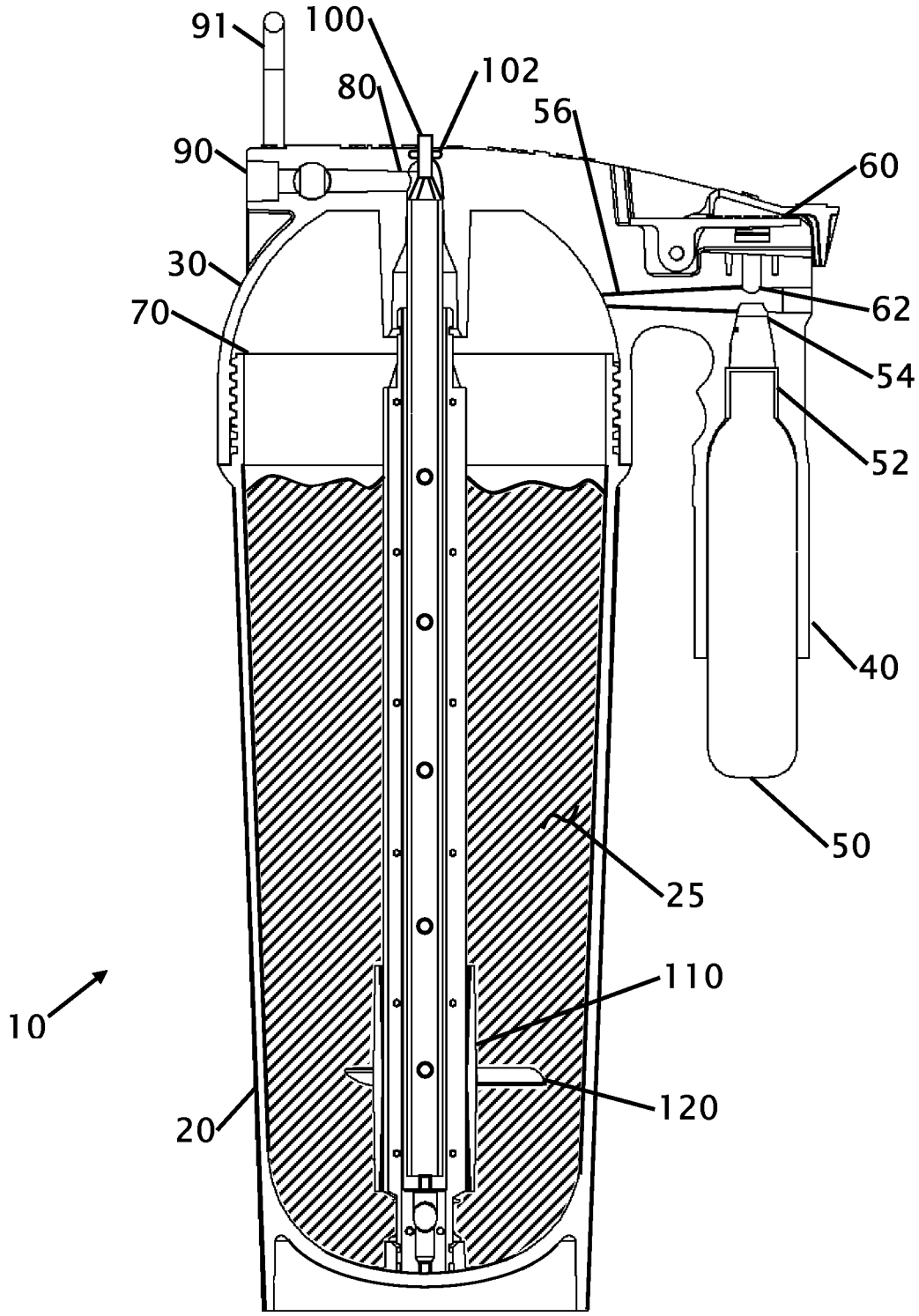
FIG. 6 shows a side sectional view of a second preferred embodiment of the fire extinguisher where the fluffing connection is from the top of the fire extinguisher.

FIG. 6 shows a side sectional view of a second preferred embodiment of the fire extinguisher where the fluffing connection is from the top of the fire extinguisher. This figure shows the chamber 20 filled with the fire extinguishing media 25. In the preferred embodiment the chamber is made from a lightweight resilient material such as plastic, but the chamber could also be made of steel, brass, copper or aluminum. Various types of fire extinguishing media can be placed within the chamber. The upper portion of the chamber includes an enlarged opening 70 where it joins with the top 30 of the extinguisher. The enlarged opening 70 is greater than 50% of the diameter of the cylindrical fire extinguisher, but could be up to and including the same diameter as the cylinder with a threading mechanism located on the exterior lip of the cylinder. It is also contemplated that the cylinder be fabricated from tubular stock where both the top and the bottom of the extinguisher are identical and the ends are attached to the tube when the fire extinguisher is assembled. In the preferred embodiment the opening is between 75% and 90% of the diameter of the fire extinguisher. The larger opening allows the contents of the fire extinguisher to be filled, emptied, inspected, and serviced more easily. The top is screwed onto the chamber, but it could also be attached with a bayonet or latching mechanism. The top 30 of the fire extinguisher provides the propellant and the connections to emit the fire extinguishing material 25.

A gas filled canister 50 is located within the handle 40 of the extinguisher. It can be seen from this figure that the gas canister exists substantially within the handle. The handle provides some protection to the canister for accidental damage. A small portion of the gas canister extends beyond the end of the handle to allow access to the gas canister so it can be installed, removed or serviced without the need to disassemble other parts of the fire extinguisher. The gas canister is threaded into a fitting 52 within the handle of the extinguisher. The fitting can be of a variety of types that allows engagement of the canister to the extinguisher allowing the gas to be exhausted from the canister into the body of the fire extinguisher. A trigger 60 or other activation mechanism controls a valve 62 to regulate the flow of the gas from the canister through tube 54 and into the fire extinguisher at 56. Various safety pins, locks, tabs or other devices can be incorporated to reduce or prevent the possibility of accidental activation of the trigger.

In the figure the chamber is shown only partially filled to provide a view of the fluffing mechanism(s) 120. The fluffing mechanism conditions the fire retardant media to provide anti-bridging of the media within the chamber to agitate, fluff, turn, disturb, stir, ruffle, and or alters the condition of the media to allow the media to maintain a powder consistency. This allows the fire retardant powder media to remain in a liquefied state so it is easier to spray the powder onto a fire. The conditioning of the media can be performed using a variety of methods and in the preferred embodiment the conditioning is performed with an appendage 110 that can be articulated from the exterior 100 of the chamber. A seal 102 prevents fire extinguishing media and or pressurized gas from blowing out of the eternal fluffing connection 100. The appendage is a shaft that extends the length of the chamber and has a number of flaps 120 attached to the appendage. While flaps are shown and used in the preferred embodiment a variety of other appendages are contemplated that can condition the media that include but are not limited to rods, paddles, arms, disks, cable, chains or combination thereof. It is also contemplated that the appendage can be a simple hook or chain that conditions the fire extinguishing media. As previously described the appendage terminates 100 at the bottom of the chamber where it can be articulated, but the appendage could terminate at the top or sides of the chamber. The termination at the bottom of the chamber can allow articulation that requires either a key to attach to the appendage, or may terminate with manual knob, handle, wheel or other extension.

A hole 82 extends from bottom of the fluffing tube within the chamber to a passage 80 that transports the fire extinguishing media from within the chamber to the application nozzle 90 where it exits through a hole in the end of the nozzle. In operation when the trigger 60 is depressed the valve 62 is opened and gas from the canister 50 is expelled from the tube 54 into the chamber 20. A powder expeller valve 91 is closed to prevent power from spilling out the end of the hose when not in use, and opened to allow the powder to dispense on a fire when needed. The chamber becomes pressurized and fire suppressant media 25 is pushed through tube 82 where it is dispensed out the port 80 and through the nozzle 90. In another contemplated embodiment the nozzle is flexible to allow a user to hold the fire extinguisher and direct the fire extinguishing media out of the hose to a fire. While an open port 90 is shown in the preferred embodiment other dispensing orifices can be used such as valves, tubing, spray nozzles or similar are contemplated. It is contemplated that an over pressure relief valve can be incorporated within the fire extinguisher to vent any excessive pressure from within the cylinder that could cause the fire extinguisher to burst due to over pressurization of the chamber. Another contemplated feature can be a pressure gauge that will provide information on the amount of pressure in the gas canister to ensure that it is sufficiently charged for use when needed. After using the fire extinguisher, it can be opened, refilled and the gas canister replaced to allow the fire extinguisher to be returned to service like other types of office equipment like copiers or printers.

Thus, specific embodiments of an improved fire extinguisher have been disclosed. It should be apparent, however, to those skilled in the art that many more modifications besides those described are possible without departing from the inventive concepts herein. The inventive subject matter, therefore, is not to be restricted except in the spirit of the appended claims.

What is claimed is:

1. A portable fire extinguisher comprising:

a chamber that contains powdered fire suppressing media, where said chamber further includes at least one appendage internal to said chamber and exits a top of said chamber that can be articulated from said top of said chamber to condition said powdered fire suppression media within said chamber.

2. A portable fire extinguisher according to claim 1 in which said appendage includes one or more rods, paddles, arms, disks, chains or combination thereof.

3. A portable fire extinguisher according to claim 1 in which said articulated appendage extends from within said chamber to the exterior of said chamber.

4. The articulated appendage according to claim 3 wherein the extension from said interior of the chamber to the exterior of the chamber exits said chamber on said top of said chamber.

5. A portable fire extinguisher according to claim 1 in which said conditioning of said fire suppression media agitates, fluffs, turns, disturbers, stirs, ruffles, and or alters a condition of said fire suppression media to allow said fire suppression media to maintain a powder consistency.

6. A portable fire extinguisher according to claim 1 that further includes a pressurized gas canister located, at least partially, within a handle of said fire extinguisher.

7. A portable fire extinguisher according to claim 1 in which said chamber has tapered side walls.

* * * * *